US007424992B1

(12) United States Patent
Dziedzic

(10) Patent No.: US 7,424,992 B1
(45) Date of Patent: Sep. 16, 2008

(54) BANDED MOUNT

(75) Inventor: Edward Dziedzic, Shelby, TN (US)

(73) Assignee: Aluma-Form, Inc., Memphis, TN (US)

( * ) Notice: Subject to any disclaimer, the term of this patent is extended or adjusted under 35 U.S.C. 154(b) by 1309 days.

(21) Appl. No.: 09/348,742

(22) Filed: Jul. 6, 1999

Related U.S. Application Data

(63) Continuation-in-part of application No. 29/105,273, filed on May 21, 1999, now Pat. No. Des. 427,504.

(51) Int. Cl.
*A47B 96/06* (2006.01)

(52) U.S. Cl. ..... 248/218.4; 248/219.4

(58) Field of Classification Search ..... 248/218.4, 248/219.1, 219.3, 219.4, 499, 500; 52/166, 52/155, 162, 164
See application file for complete search history.

(56) References Cited

U.S. PATENT DOCUMENTS

| | | | | |
|---|---|---|---|---|
| 1,653,083 | A | 12/1927 | Blaw | |
| 1,907,889 | A | 5/1933 | Stauffer | |
| 2,383,881 | A | 8/1945 | Murphy | |
| 2,651,094 | A | 9/1953 | Dodge | |
| 2,703,216 | A | 3/1955 | Petersen | |
| 2,706,023 | A | 4/1955 | Merritt | |
| 2,780,205 | A | 2/1957 | Banck | |
| 2,977,995 | A | 4/1961 | Walpole | |
| 3,241,800 | A | 3/1966 | Richter, III | |
| 3,374,978 | A | 3/1968 | Salmon et al. | |
| 3,462,110 | A | 8/1969 | Cheslock | |
| 3,734,438 | A | 5/1973 | Kautz | |
| 3,750,992 | A | 8/1973 | Johnson | |
| 3,894,707 | A | 7/1975 | Heard | |
| 4,066,233 | A | 1/1978 | Heard | |
| 4,125,240 | A | 11/1978 | Heard | |
| 4,211,381 | A | 7/1980 | Heard | |
| 4,325,259 | A | 4/1982 | Willertz | |
| 4,325,529 | A * | 4/1982 | Seebinger | 248/219.4 X |
| 4,635,888 | A | 1/1987 | Aldridge et al. | |
| 4,659,046 | A * | 4/1987 | Parduhn | 248/231 |
| 4,759,521 | A | 7/1988 | Aldridge et al. | |
| 5,098,051 | A | 3/1992 | Aldridge et al. | |
| 5,310,151 | A * | 5/1994 | Engel | 248/231 |
| 5,335,889 | A * | 8/1994 | Hopkins et al. | 248/231 |

* cited by examiner

*Primary Examiner*—A. Joseph Wujciak, III
(74) *Attorney, Agent, or Firm*—Pual M Denk

(57) ABSTRACT

A removable mount to be secured to a utility pole or the like for the attachment of a stabilizer wire including a generally flat, rectangular base plate having a top surface and a bottom surface with an integral upwardly extending attachment loop positioned centrally on a boss on the top surface of the base plate. The loop is configured to accept a stabilizer wire. The top surface of the base plate also includes at least one pair of transverse raised ribs, one each of the pair of ribs being positioned on each side of the boss and spaced apart from the boss to create a pair of shallow channels between the boss and the ribs for the seating of attachment bands. The bottom surface of the base plate has downwardly depending serrated edges disposed to bite into the mounting surface when the attachment bands are tightened to prevent slippage of the mount on the mounting surface.

6 Claims, 3 Drawing Sheets

BANDED MOUNT

CROSS-REFERENCE TO RELATED APPLICATIONS

This application is a continuation-in-part of design patent application Ser. No. 29/105,273, filed May 21, 1999.

BACKGROUND OF THE INVENTION

The invention relates generally to mounts and more particularly to a mount for the attachment of guy-wires or cables and the like to a stationary object such as a pole. The mount is designed to be attachment to the pole by one or more bands or small cables.

Mounts for the removable attachment of wires, such as guy-wires or stabilizer wires, to utility poles are known to the art. Generally, speaking mounts are attached to the pole or a cross member and a stabilizer wire or guy-wire is attached between the mount and the ground, for example, to stabilize the utility pole. The mount usually includes some means, such as a ring or loop, to which the stabilizer wire is attached. For example a large eye-bolt can be attached to the pole or cross member with the stabilizer wire or cable attached through the eye. The eye-bolt type of mount requires mounting by drilling through the pole or cross member. Once the eye-bolt type of mount is attached it is difficult to move. For example, the workman must remove the eye-bolt, drill another hole and then attach the mount in the desired position. Often a typical mount may rust or deteriorate when exposed to the elements, perhaps causing it to fail or making it difficult to remove. It would be advantageous, therefore, to have a mount for cables, guy-wires or stabilizer wires that can be removably attached to a pole or the like so that it is easy to install without drilling, screwing etc., that provides a stable mount, and can be readily repositioned or reused.

SUMMARY OF THE INVENTION

It is among the principal objects of the present invention to provide a mount for the removable attachment to a fixed object, such as a utility pole, to accommodate the attachment of a stabilizer wire or cable to the pole.

It is another object of the present invention to provide such a mount that can be attached to the pole or a cross member with removable attachment bands to allow replacement or movement of the mount.

Still another object of the invention is to provide such a mount that has channels for the seating of the attachment bands to prevent slippage of the band off the mount and inadvertent failure of the mount.

Yet another object of the invention is to provide such a mount that has integral serrated edges that allow the mount to grip the mounting surface to avoid slippage of the mount on the mounting surface.

Still another object of the present invention is to provide such a mount that has an integral ring or loop for the removable attachment of the stabilizer wire or guy-wire.

A still further object of the present invention is to provides such a mount that is constructed from a weather resistant material such as aluminum.

These and other objects of the invention will be readily apparent to one skilled in the art upon a review of the written description and accompanying drawings.

In accordance with the invention, generally stated, a removable mount to be secured to a utility pole or the like for the attachment of a stabilizer wire is provided including a generally flat, rectangular base plate having a top surface and a bottom surface and an upwardly extending wire attachment loop on a raised boss positioned substantially centrally on the top surface of the base plate. The loop is designed to accept the stabilizer wire or the like. The top surface of the base plate also includes at least one pair of transverse raised ribs, one each of the pair of ribs positioned on each side of the boss and spaced apart from the boss so as to create a pair of shallow channels between the boss and the ribs for the seating of attachment bands in the channels. A mounting band is positioned in each channel and tightened around the utility pole or cross member to secure the mount to the mounting surface. There is a pair of opposed serrated edges depending from the bottom edges of the base plate. These serrated edges bite into the mounting surface when the attachment bands are tightened to prevent slippage of the mount on the mounting surface. Generally the mount is cast as one piece from aluminum or other weather resistant and lightweight materials.

BRIEF DESCRIPTION OF THE DRAWINGS

Corresponding reference numerals indicate corresponding structure and elements throughout the various view.

DESCRIPTION OF THE PREFERRED EMBODIMENT

Figure 1:
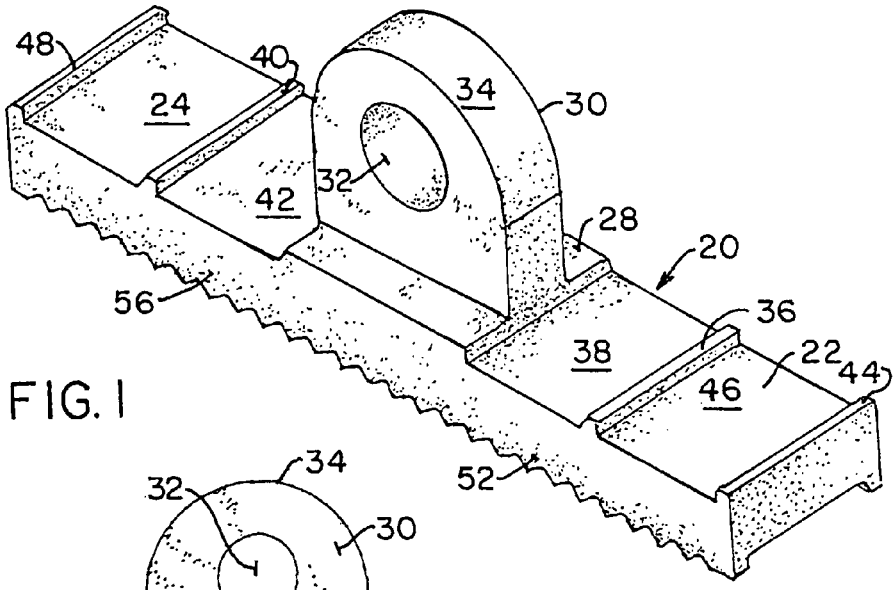
FIG. 1 is an isometric view of the bandable mount of this invention.
Figure 2:
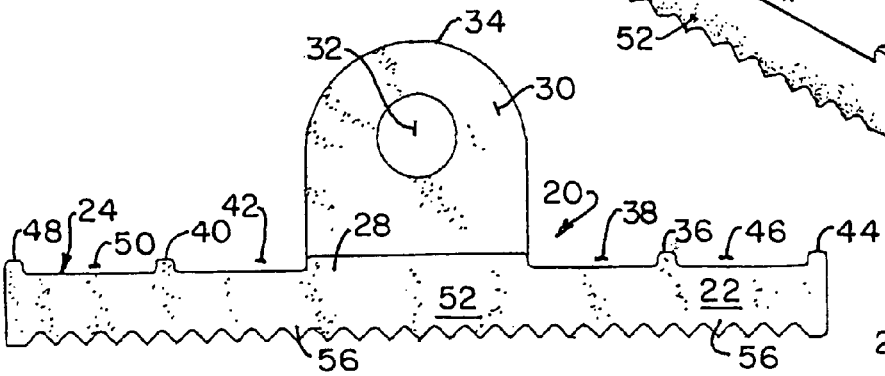
FIG. 2 is a side view thereof, the opposite side view being a mirror image thereof.
Figure 4:
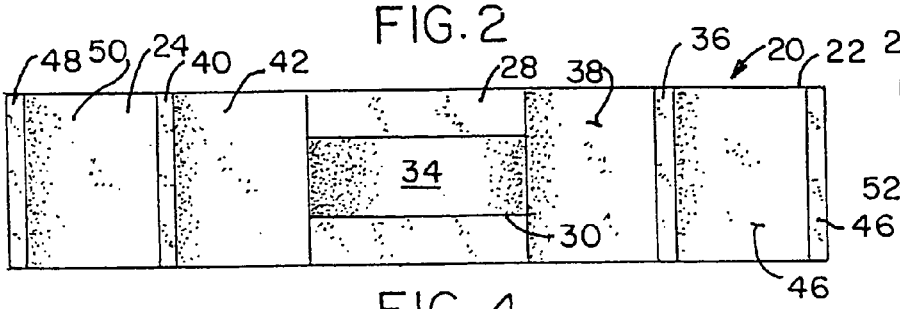
FIG. 4 is a top view thereof.
Figure 3:
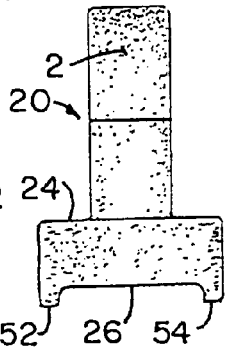
FIG. 3 is an end view, the opposite end view being a mirror image thereof.
Figure 5:
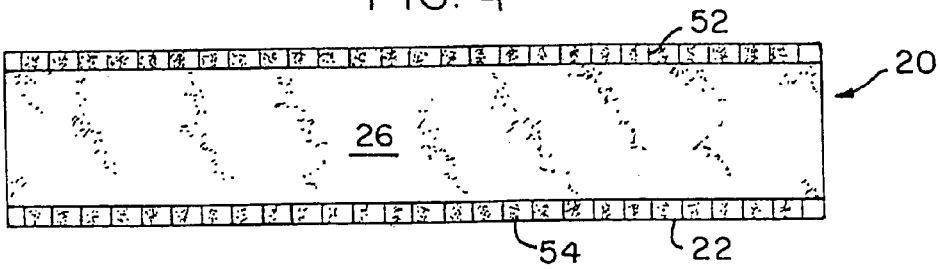
FIG. 5 is a bottom view of the invention.
Figure 6:
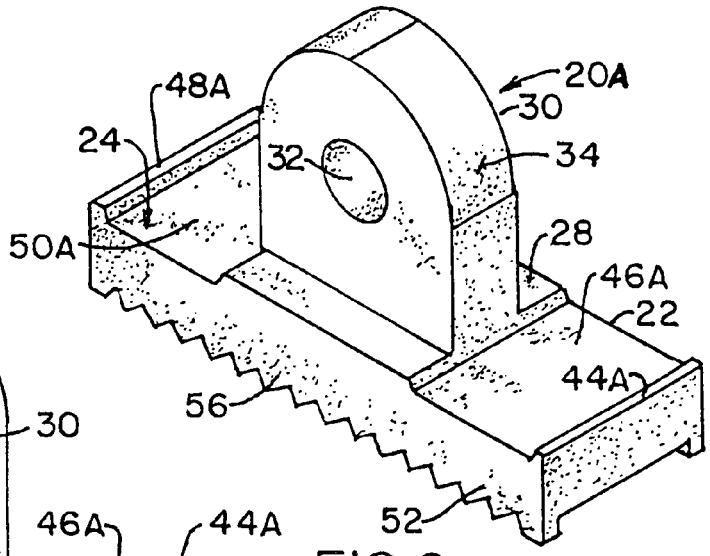
FIG. 6 is an isometric view of a modified bandable mount.
Figure 7:
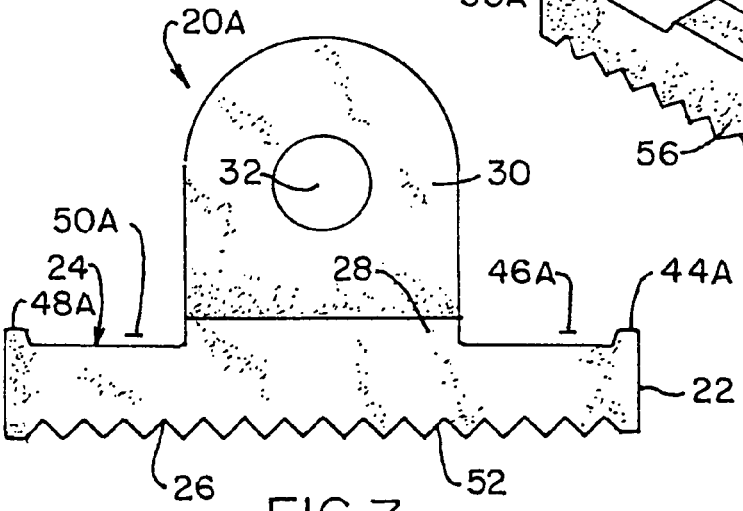
FIG. 7 is a side view, the opposite side view being a mirror image thereof.
Figure 8:
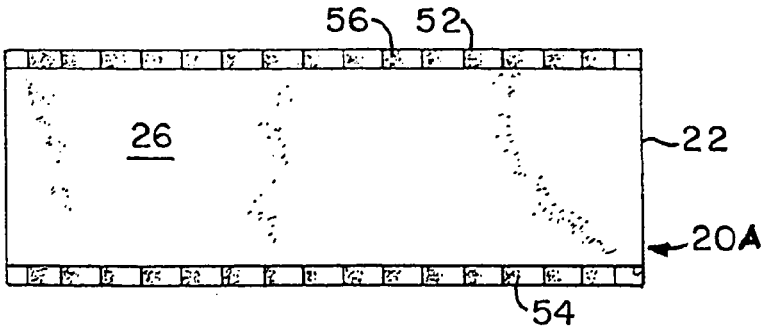
FIG. 8 is a bottom view of the invention.
Figure 9:
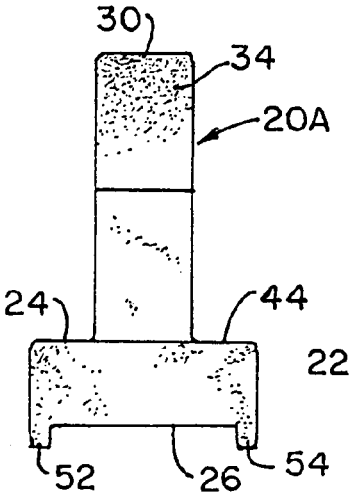
FIG. 9 is an end view, the opposite end view being a mirror image thereof.
Figure 10:
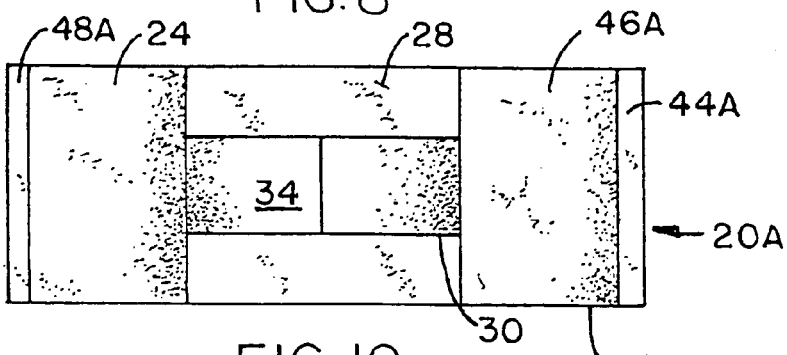
FIG. 10 is a top view thereof.

A bandable mount of the present invention is indicated generally by reference numeral 20 in FIGS. 1 through 5 and 11. A modified bandable mount of the present invention is indicated generally by reference numeral 20A in FIGS. 6-10. It will be appreciated by those skilled in the art that mount 20 and 20A include similar structures and are employed in the same way. However, mount 20A has a shorter base plate and accommodates fewer bands for attachment to a pole or the like and, thus, is employed in a lighter duty application. Moreover, it will be apparent to one skilled in the art that the mount 20 can be adapted to accommodate a greater number of securing bands and that all such embodiments are intended to be included within the scope of the invention.

Figure 11:
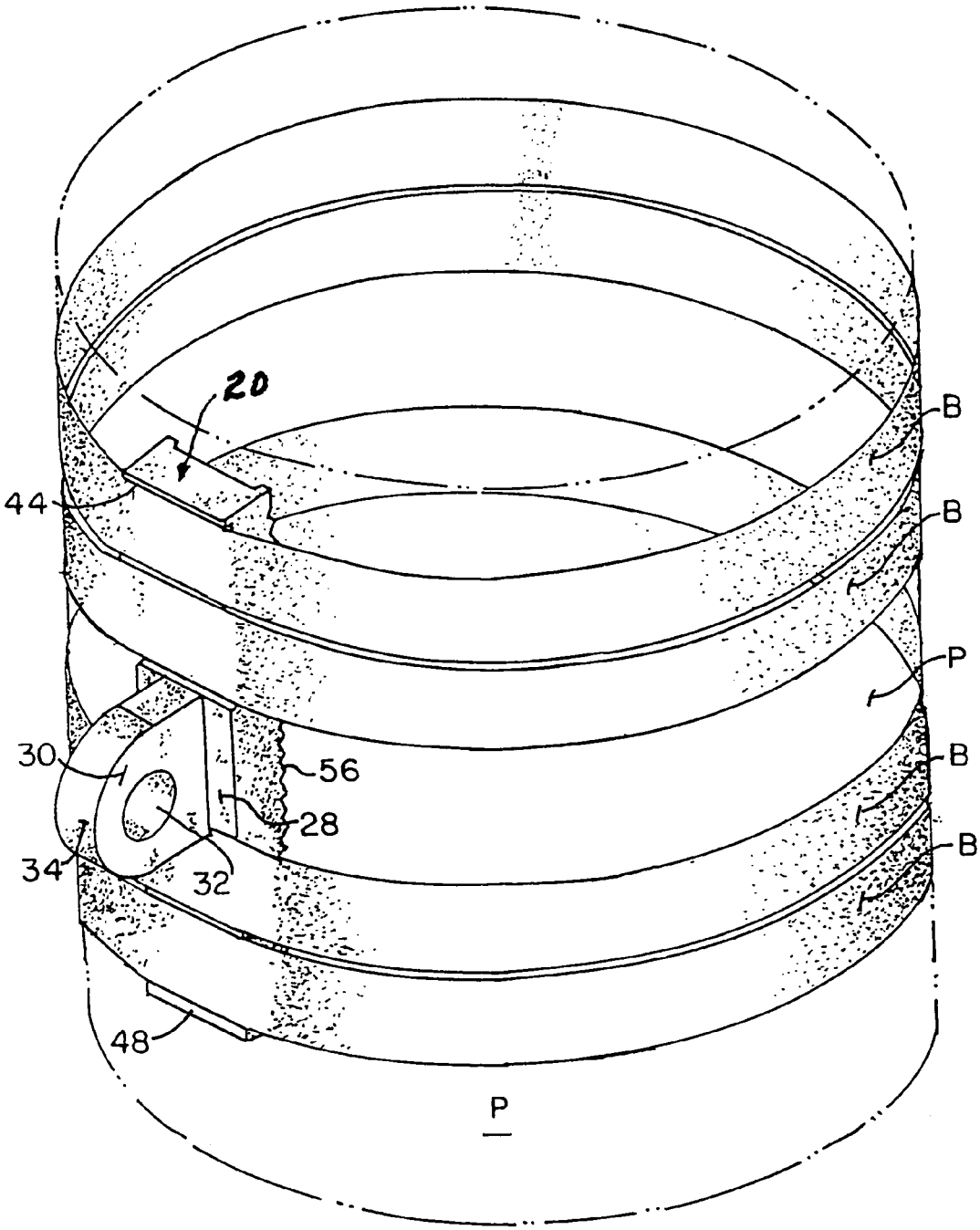
FIG. 11 is an isometric view of a bandable mount of FIG. 1 banded to a pole to illustrate environment.

Mount 20 (and 20A) includes a base plate 22 having a substantially rectangular configuration with a top surface 24 and a bottom surface 26. There is a raised, generally rectangular boss 28 positioned at the midpoint of top surface 24. An attachment loop 30, having a central hole opening or 32 therethrough, extends upwardly from boss 28. In the illustrated embodiments, loop 30 has a rounded top surface 34, however, the loop (including a central opening) can be of any desired configuration. It will be appreciated that opening 32 is dimensioned to accommodate the insertion of the end of a stabilizer wire or guy wire (not shown) when the mount 20 is attached to a pole or the like (FIG. 11). Although for the brevity and clarity the attachment means has been described as a loop, it will be appreciated by those skilled in the art that the use of the term "loop" is intended to include any appropriate structure that allows for the attachment of an end of a guy wire or stabilizer wire or cable, without departing from the scope of the invention.

1. The top surface 24 of mount 20 includes a first raised rib 36 which is positioned an appropriate distance from boss 28 to create a shallow channel 38 therebetween. There is a second raised rib 40 on the opposite side of boss 28 and space apart from the boss a distance equal to that as between the boss 28 and rib 36 to create another shallow channel 42. There is third raised rib 44 on the surface 24 of the base plate located at the end of the base plate and spaced an appropriate distance from rib 36 to create a shallow channel 46 therebetween. Correspondingly, there is a raised rib 48 on the opposite end of the top surface and spaced an appropriate distance from rib 40 to create a shallow channel 50 therebetween. It will be appreciated by those skilled in the art that mount 20A includes only two raised ribs 44A and 48A at the ends of the base plate and spaced an appropriate distance from boss 28 to create shallow channels 46A and 50A respectively. It will be noted that the various raised ribs run transverse to the horizontal length of the base plate and parallel to the ends of the base plate. The various shallow channels previously described are configured with appropriate widths and depths to seat a securing or tightening band B (FIG. 11) as will be described in greater detail below.

To prevent slippage of the mount 20 (or 20A) on a pole or other mounting surface, bottom surface 26 includes a first depending serrated edge 52 running along the length of one edge of the bottom surface and a second depending serrated edge 54 running along the length of the opposite edge of the bottom surface. As will be appreciated, the respective serrated edges 52 and 54 are comprised of an aligned array of individual pointed teeth 56. The teeth 56 are designed to bite into the mounting surface when the mount 20 (20A) is attached to a pole P as shown in FIG. 11 as will now be described in greater detail.

FIG. 11 illustrates a mount 20 secured to a pole P. Pole P is intended to illustrate a mounting surface and can be a utility pole, a cross member for a utility pole or any other type of structure to which the user desires to attach a mount and should not be construed as limiting. The mount 20 (or 20A) is position on the pole P in a desired location. Force can be applied to the top surface of the mount to cause the teeth 56 to slightly sink or bite into the pole P. Bands B are seated in the channels formed by the raised ribs and appropriately tightened. The tightening of the bands B will cause the teeth 56 to bite into the pole and keep the mount from slipping. Once secured, a stabilizer wire or guy wire can be attached through opening 32 and appropriately secure.

It will be appreciated by those skilled in the art that bands B also could be thin cables or other appropriate securing means that will seat in the various channels and tighten against the pole. It should be understood that the term "band" is used to encompass any element which can seat in a shallow channel and extend or wrap around the pole or cross member and be sufficiently tightened to secure the mount 20 (20A) in place. The various bands or cables encompassed by the term "band" can be drawn tight and secured by clamps or other conventional means.

It also will be appreciated by those skilled in the art that the mounts 20 and 20A preferably are cast as one piece from lightweight, durable, weather-resistant material such as aluminum. However, the various elements could be manufactured separately and appropriately joined by welding, bolts or the like.

The invention claimed is:

1. A stabilizer wire mount for attachment to a mounting surface on a pole by attachment bands comprising:

a singular base plate having a top surface and a bottom surface, said bottom surface having front and back edges;

an integral boss position substantially centrally on the top surface, and extending integrally substantially upwardly therefrom;

a loop formed integrally in the boss, the loop defining an opening therethrough for the attachment of the stabilizer wire;

at least one upwardly extending raised rib on the top surface at an appropriate distance from the boss, thereby defining a channel between the boss and the at least one raised rib for the seating of an attachment band; and a pair of depending serrated edges on the bottom surface of the base plate, one of each pair extending downwardly proximate the front and back edges of the bottom surface for the base plate, said depending serrated edges disposed to engage the utility pole upon a tightening of the band.

2. The mount of claim 1 wherein the top surface includes a second raised rib positioned an approximate distance from the boss on a side of the boss opposite that of the at least one raised rib thereby defining a channel between the boss and the second raised rib for the seating of an attachment band.

3. The mount of claim 2 wherein the top surface includes a third raised rib on same side as the at least one raised rib and positioned an appropriate distance from the at least one raised rib thereby defining a channel between the at least one raised rib and the third raised rib for the seating of an attachment band.

4. The mount of claim 3 wherein the top surface includes a fourth raised rib on a side of the boss opposite that of the at least one raised rib and positioned an appropriate distance from the second raised rib thereby defining a channel between the second raised rib and the fourth raised rib for the seating of an attachment band.

5. The mount of claim 1 wherein the base plate is substantially rectangular in configuration.

6. The mount of claim 1 wherein the elements of the mount are integrally cast from aluminum.

* * * * *